US006896542B2

(12) United States Patent
Chang

(10) Patent No.: US 6,896,542 B2
(45) Date of Patent: May 24, 2005

(54) STACKED MULTI PORT CONNECTOR WITH LIGHT-EMITTING ELEMENT

(75) Inventor: Chih-Kai Chang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/782,940

(22) Filed: Feb. 23, 2004

(65) Prior Publication Data

US 2004/0203280 A1 Oct. 14, 2004

(30) Foreign Application Priority Data

Apr. 8, 2003 (TW) ..... 92205484 U

(51) Int. Cl.[7] ..... H01R 3/00

(52) U.S. Cl. ..... 439/490; 439/620; 439/107; 439/676; 439/95

(58) Field of Search ..... 439/488–490, 439/676, 107–108, 95

(56) References Cited

U.S. PATENT DOCUMENTS 6,120,318 A * 9/2000 Reed et al. ..... 439/490
6,227,911 B1 * 5/2001 Boutros et al. ..... 439/620
6,729,906 B1 * 5/2004 Simmons et al. ..... 439/607

* cited by examiner

*Primary Examiner*—Truc Nguyen
(74) *Attorney, Agent, or Firm*—Birch, Stewart, Kolasch & Birch, LLP

(57) ABSTRACT

A stacked multi port connector with the light-emitting element is described. The stacked multi port connector with the light-emitting element has a transmission module, having an adapting device, a positioning set, a frontal cover and a plurality of light-emitting elements, wherein the adapting device comprises a terminal set having a plurality of signal output terminals penetrating there-through. The positioning set is positioned at a bottom face of the adapting device. The positioning set comprises a plurality of through holes and a plurality of signal input terminals penetrating there-through. The frontal cover comprises a plurality of slots formed on a surface thereon and a plurality of receiving spaces for positioning the light-emitting elements. A plurality of protrusions is formed on two sides of a bottom flange, and wherein the frontal cover covers an outer portion of the adapting device. The signal output terminals of adapting advice are positioned between said protrusions of the frontal cover and signal input terminals of said back cover. A case covers the transmission module.

8 Claims, 7 Drawing Sheets

STACKED MULTI PORT CONNECTOR WITH LIGHT-EMITTING ELEMENT

This Nonprovisional application claims priority under 35 U.S.C. §119(a) on patent application Ser. No(s). 092205484 filed in TAIWAN on Apr. 8, 2003, the entire contents of which are hereby incorporated by reference.

BACKGROUND OF THE INVENTION

1. The Field of the Invention

The present invention is generally related to a stacked multi port connector with light-emitting element, and more particularly to a stacked multi port connector with light-emitting element, wherein a transmission terminal of the adapting device is positioned between the protrusion of the frontal cover and the signal input terminal of the back cover to fit the light-emitting element through the plurality of slots formed on the frontal cover. Accordingly the inclusion of the light-emitting element does not occupy any extra space on the stacked multi port connector, and therefore the size of the stacked multi port connector will not be increased.

2. Description of Related Art

The well-developed latest computer network technology has brought people closer than ever, as well as supplied variety of information for improving the knowledge. This trend has increased the demand of telephone lines for either office or household use. The users are usually required to preset the telephone line for the internet use during construction of the building or during interior decoration. Accordingly, some manufacturers in this field has invented a network board that can be installed on the wall, wherein the network board was initially designed to have a socket or switch that function like the common electrical appliances, and with the continued development in this field has gradually lead to switchable plug, and presently a plurality of optical fibers are being used for transmission and telephone lines. And for allowing a plurality of users to use at the same time, a stacked multi port network connector has been developed. However, the conventional stacked multi port network connector is only for allowing a plurality of users to enjoy the service at the same time and that is why the common connector has no display element for identifying the users' status. Further, because of the structure and the terminal placement of the conventional connector, if the user wants to have a display element on the connector, the transmission end of the display element has to reach to the backside of the connector for the further connection with the motherboard, and therefore this design will further increase the size of the connector.

Nevertheless, the above structure and design of the connector increase the manufacturing cost and also have limited application. Therefore, how to solve the above defects of the conventional design has become an important issue for the manufacturer in the field.

SUMMARY OF THE INVENTION

Accordingly, in the view of the foregoing, the present inventor makes a detailed study of related art to evaluate and consider, and uses years of accumulated experience in this field, and through several experiments, to create a new stacked multi port connector with light-emitting element. The present invention provides an innovated cost effective stacked multi port connector with light-emitting element so that the manufacturing cost thereof can be substantially reduced and has more applications.

According to an aspect of the present invention, the transmission terminal of the adapting device is positioned between the protrusion of the frontal cover and the signal input terminal of the back cover so that the light-emitting element can be fitted through the plurality of the slots of the frontal cover according to the need of the user. Thus inclusion of the light-emitting element does not occupy any extra space on the stacked multi port connector so that the size of the stacked multi port connector will not be increased.

According to another feature of the present invention, after positioning the adapting device onto the surface of the back cover, the adapting device can be arranged in an orderly manner and can be covered by the frontal cover to complete the assembly of the stacked multi port connector. Additionally, for meeting various requirements of the users, the plurality of slots of the frontal cover can fit the light-emitting element for different applications.

BRIEF DESCRIPTION OF THE DRAWING

For a more complete understanding of the present invention, reference will now be made to the following detailed description of preferred embodiments taken in conjunction with the following accompanying drawings.

DETAILED DESCRIPTION OF PREFERRED EMBODIMENTS

Figure 1:
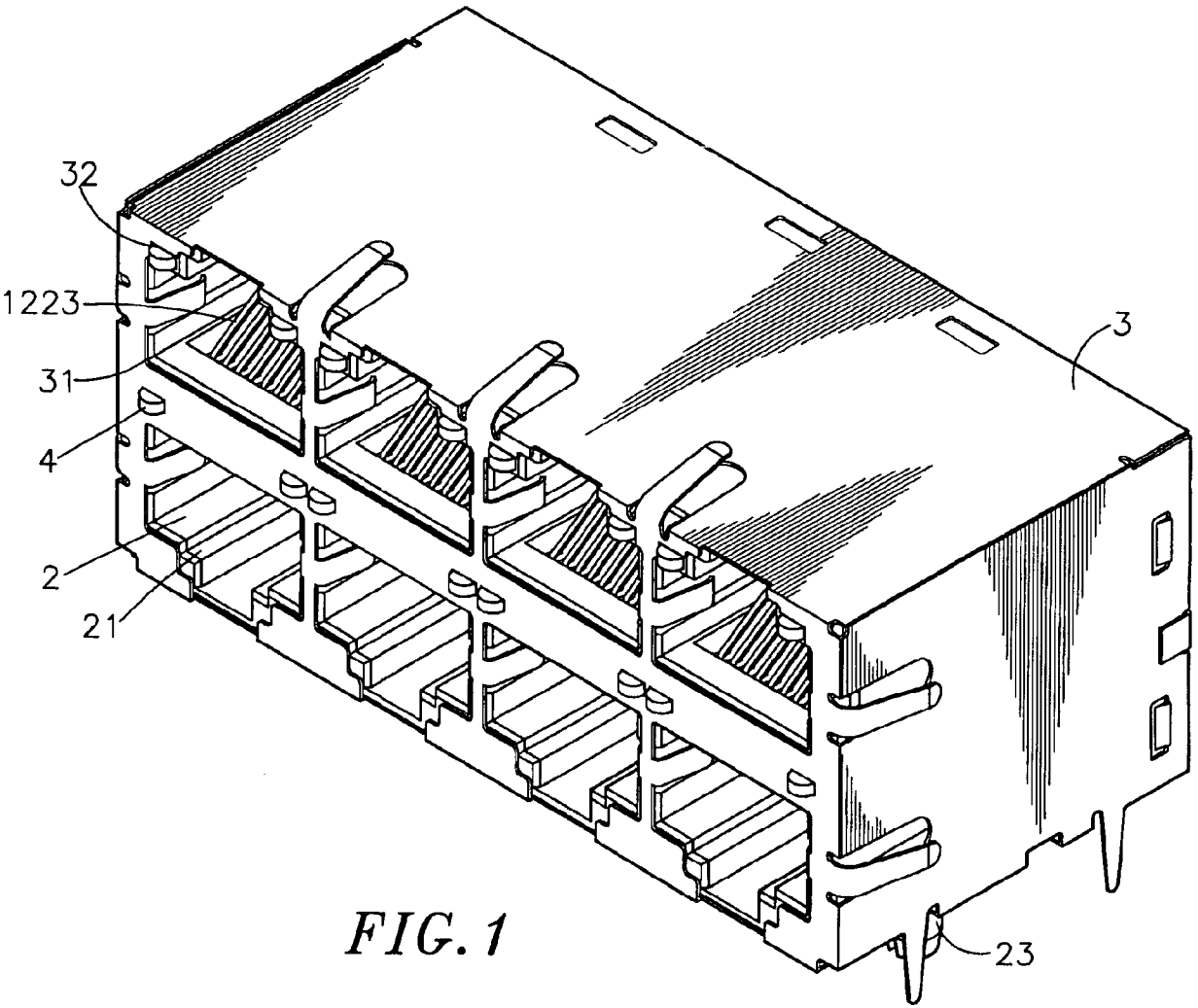
FIG. 1 is an elevational view of a stacked multi port connector with light-emitting device according to a preferred embodiment of the present invention.
Figure 2:
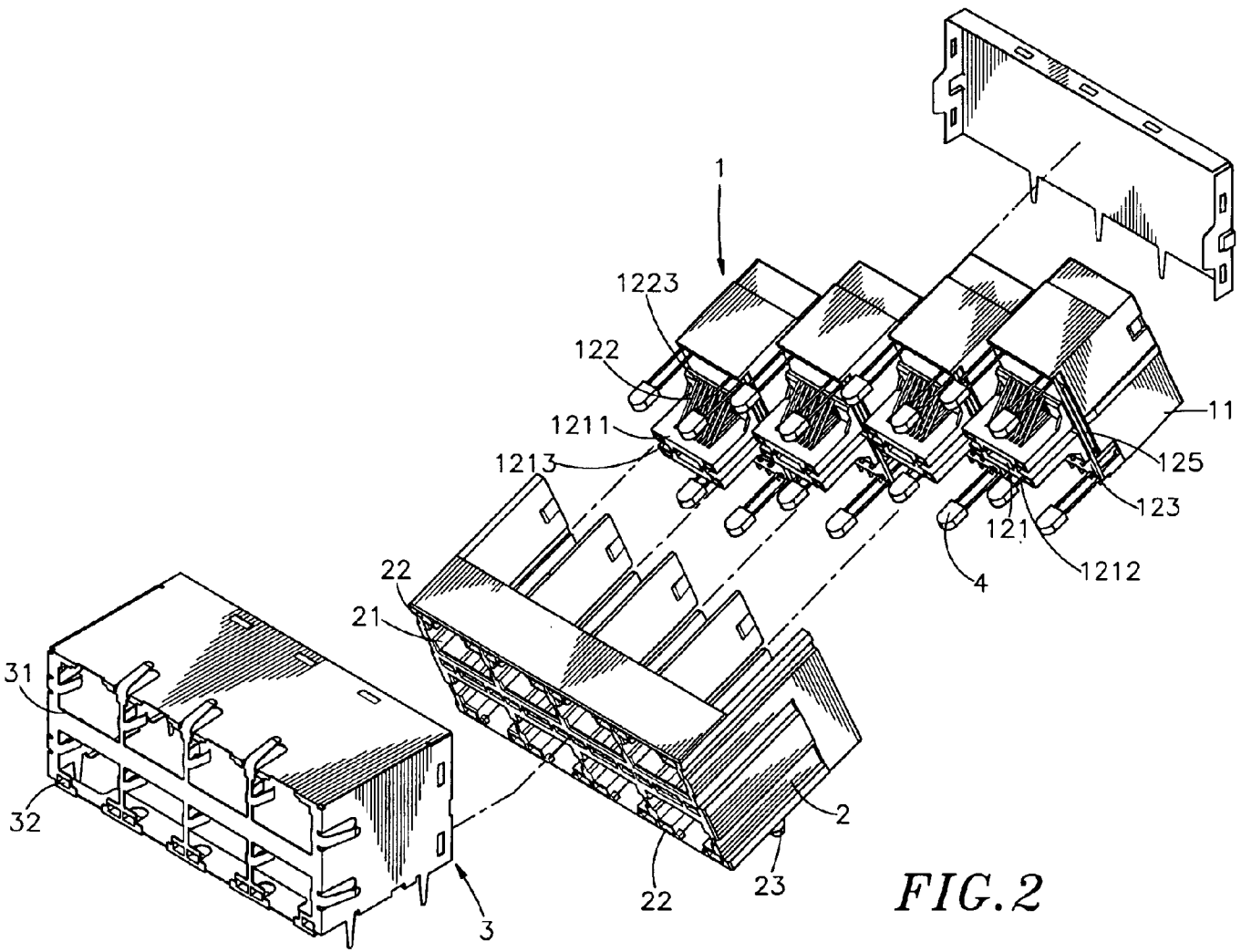
FIG. 2 is an exploded view of a stacked multi port connector with light-emitting device according to a preferred embodiment of the present invention.
Figure 3:
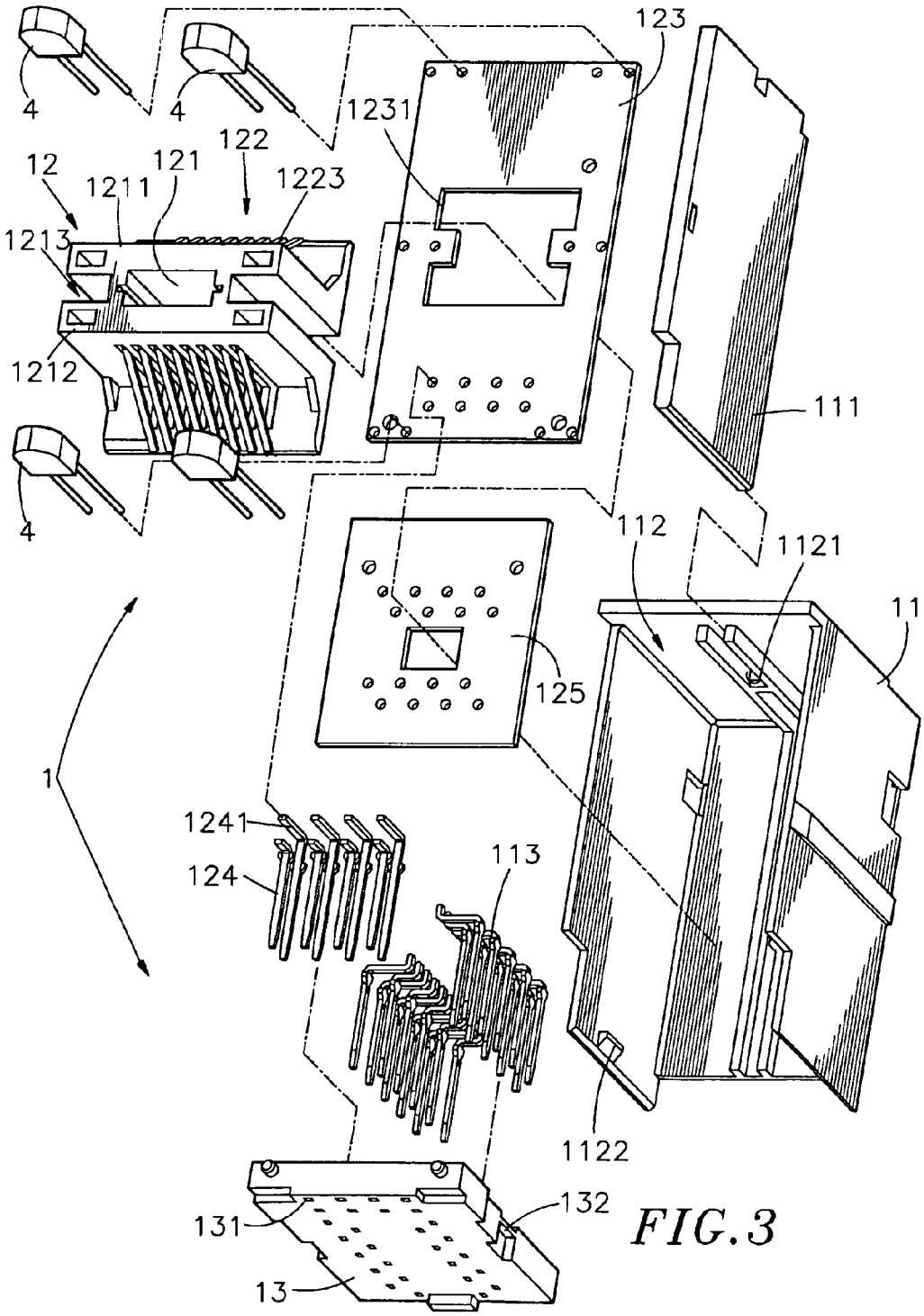
FIG. 3 is an exploded view of an adapting device, back cover and positioning set of a stacked multi port connector with light-emitting device according to a preferred embodiment of the present invention.
Figure 4:
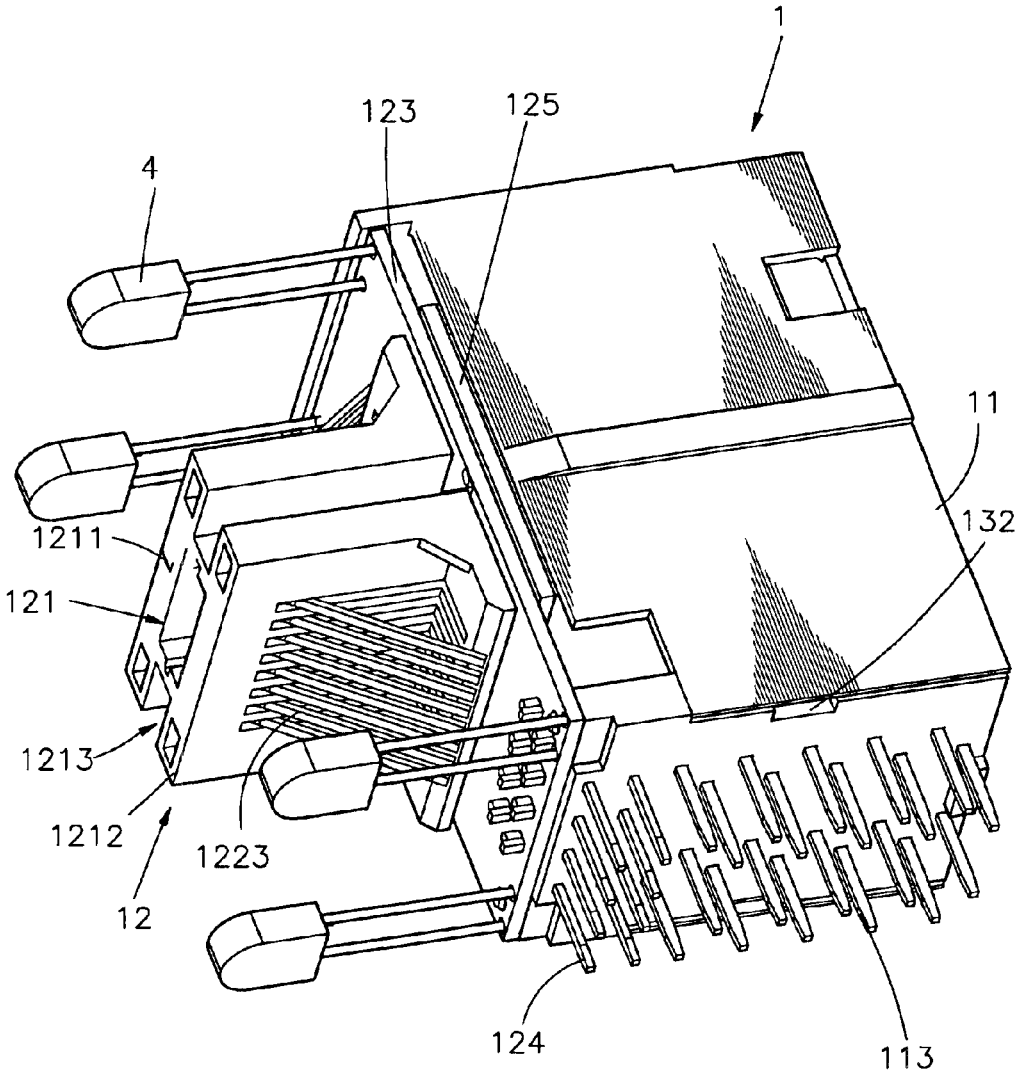
FIG. 4 is an elevational view of the adapting device, back cover and positioning set of a stacked multi port connector with light-emitting device according to a preferred embodiment of the present invention.
Figure 5:
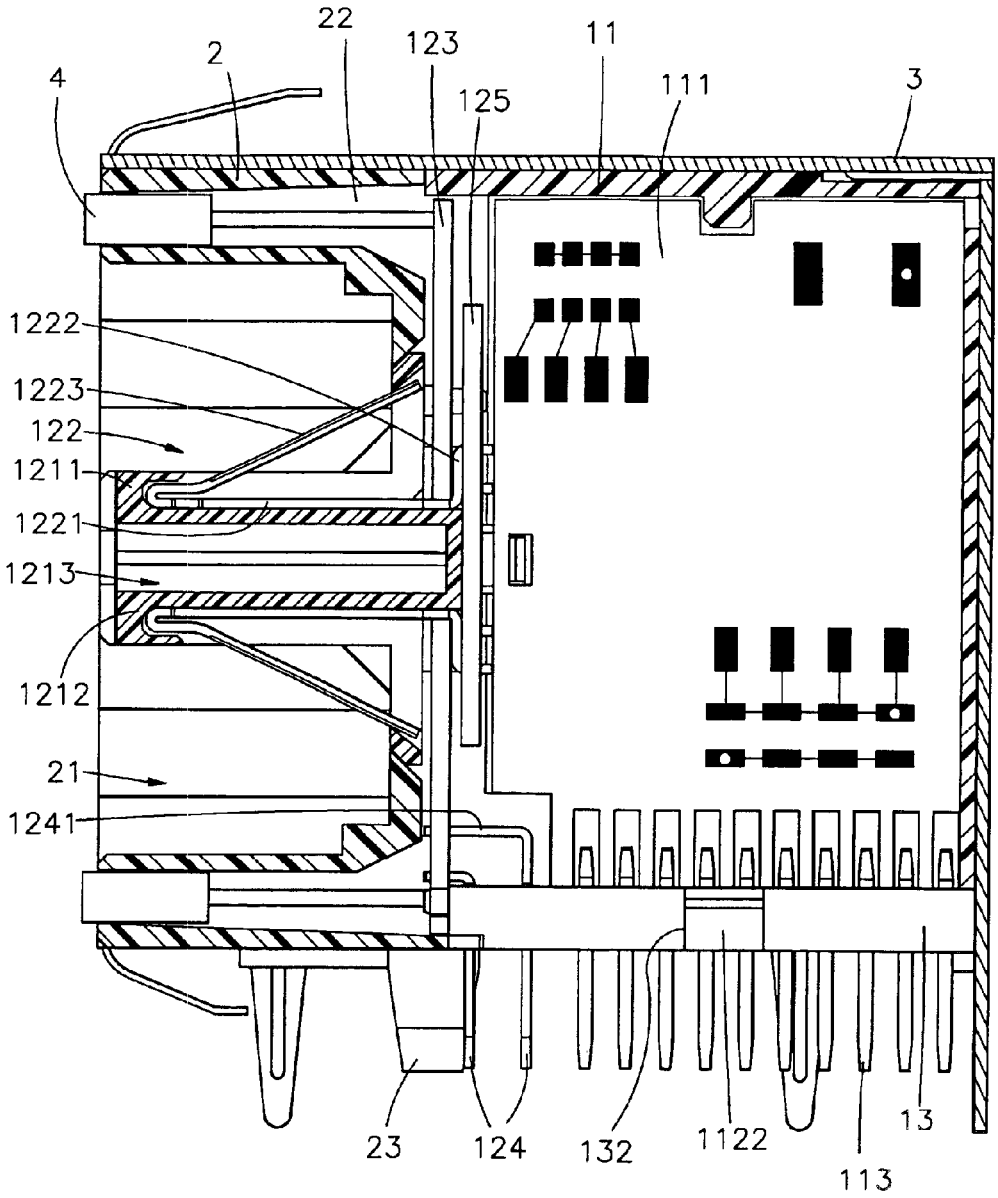
FIG. 5 is a sectional side view of the stacked multi port connector with light-emitting device according to a preferred embodiment of the present invention.

Reference will be made in detail to the preferred embodiments of the invention, examples of which are illustrated in the accompanying drawings. Wherever possible, the same reference numbers are used in the drawings and the description to refer to the same or like parts.

Referring to FIGS. 1, 2, 3 and 4, an elevational view, an exploded view, an exploded view of a adapting device, back cover and positioning set, and an elevational view of a adapting device, back cover and positioning set, of a stacked multi port connector with light-emitting device according to a preferred embodiment of the present invention are respectively shown. The stacked multi port connector with light-emitting device of the present invention comprises a transmission module 1 and a case 3 covering the transmission module 1. The transmission module 1 comprises a back cover 11, an adapting device 12, a positioning set 13 and a frontal cover 2.

The back cover 11 comprises a receiving space 112 for positioning the transmission circuit board 111. The transmission circuit board 111 comprises a plurality of signal input terminals 113 welded on two sides thereof. The receiving space 112 of the back cover 11 comprises a groove 1121, which is for inlaying the flange of the transmission circuit board 111, and the receiving space 112 further comprises a plurality of buckles 1122 at a button side thereof.

The adapting device 12 comprises a terminal set 121. The terminal set 121 comprises a protruded upper portion 1211 and a lower portion 1212, wherein the upper portion 1211 and the lower portion 1212 have a plurality of signal output terminals 122 penetrating there-through. A connecting circuit board 123 is positioned at a rear side of the terminal set 121, wherein the connecting circuit board 123 comprises a plurality of transmission terminals 124 welded thereon. A through channel 1213 for fitting the light-emitting element 4 is disposed between the upper portion 1211 and lower portion 1212 of the terminal set 121. Furthermore, the connecting circuit board 123 of the adapting device 12 has a through groove 1231, and a signal connecting circuit board 125 is positioned at the backside of the connecting circuit board 123. The signal output terminal 122 comprises a base 1221. The signal output terminal 122 comprises a welding portion 1222 on one side and a bent receiving end portion 1223 on another side, wherein the welding portion 1222 of the signal output terminal 122 penetrates through the through groove 1231 of the connecting circuit board 123 and then is welded securely onto the signal connecting circuit board 125.

The positioning set 13 has a plurality of through holes 131 formed on a surface thereon. A buckling groove 132 is formed respectively on two sides of the positioning set 13.

The frontal cover 2 comprises a plurality of slots 21 and a plurality of receiving spaces 22 are formed on an outer surface thereon, and a plurality of protrusion 23 is formed at a bottom flange thereon.

The assembly of the stacked multi port connector with light emitting element will be described as follows. The light-emitting element 4 is welded at a prescribed position to securely fit the light-emitting element 4 to the connecting circuit board 123 of the adapting device 12. Next, the welding portions 1222 of signal output terminals 122 of the adapting device 12 are penetrated through the through groove 1231 of the connecting circuit board 123 and then are welded onto the signal connecting circuit board 125. Next, the plurality of the transmission terminals 124 and signal input terminals 113 are penetrated through the plurality of through holes 131 formed on the surface of the positioning set 13 and then are welded onto the two sides of the transmission circuit board 111 of the back cover 11. Next, the connecting circuit board 123 of the adapting device 12 and the bent portion 1241 of the plurality of transmission terminals 124 are welded to position the adapting device 12 and the transmission circuit board 111 of the back cover 11. Next, a proper electrical device (not shown in the figure) is installed on the transmission circuit board 111 and the signal connecting circuit board 125. Further, the back cover 11 is covered from top and then the edge of the transmission circuit board 111 is pushed into the groove 1121 formed within the receiving space 112 of the back cover 11 and the plurality of buckles 1122 formed at the bottom flange of the receiving space 112 of the back cover 11 buckle onto the buckling grooves 132 formed at the two sides of the positioning set 13. Thus assembly of the back cover 11, adapting device 12 and the positioning set 13 of the electrical transmission module 1 is completed.

Furthermore, after completing the assembly of the above transmission module 1, the transmission module 1 fitted onto the frontal cover 2 in a proper number, making the plurality of slots 21 face the plurality of signal output terminals 122 positioned at the upper and lower portion 1211 and 1212 of the terminal set 121 of the adapting device 12, as well as fitting the light-emitting element 4, which is welded to the connecting circuit board 123 of the adapting device 12 through the plurality of receiving space 22 of the frontal cover 2 to position the transmission terminals 124 of the adapting device 12 between the protrusion 23 of the frontal cover 2 and the signal input terminal 113 of the back cover 11. This will also place the case 3 on the frontal cover 2 and the back cover 11. The case 3 comprises a plurality of receiving holes 31 corresponding to the slots 21 of the frontal cover 2 and the fitting portions 32 corresponding to light-emitting element 4 protrude from the receiving space 22 of the frontal cover 2, thus a plug (not shown in the figure) can plug into the receiving hole 31 of the case 3 and have the electrical connection via connecting the slot 21 of the frontal cover 2 with the signal output terminal 122. The light-emitting element 4 can display to indicate the status of the electrical connection.

Figure 6:
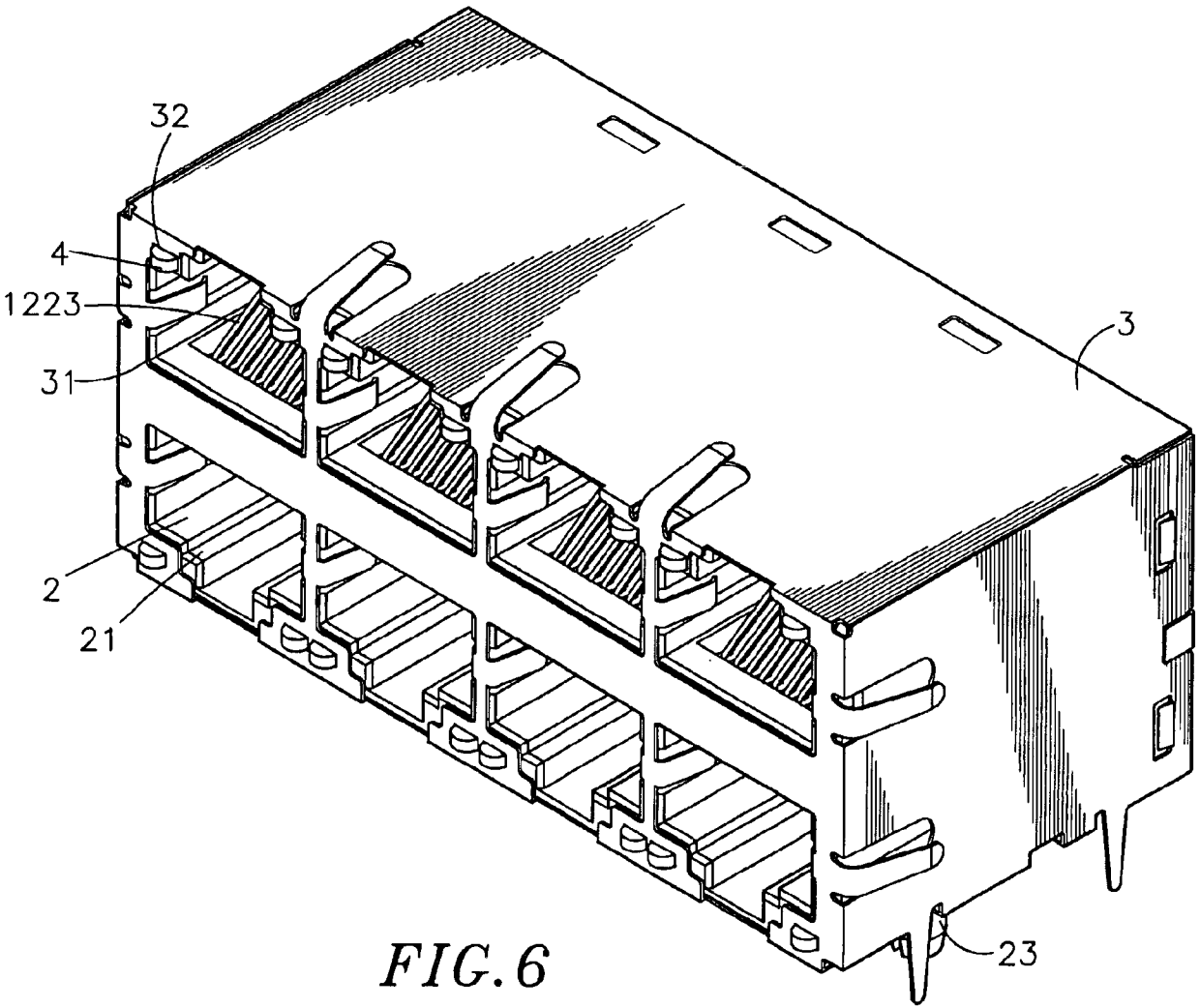
FIG. 6 is an elevational view of a stacked multi port connector with light-emitting device according to a preferred embodiment of the present invention.
Figure 7:
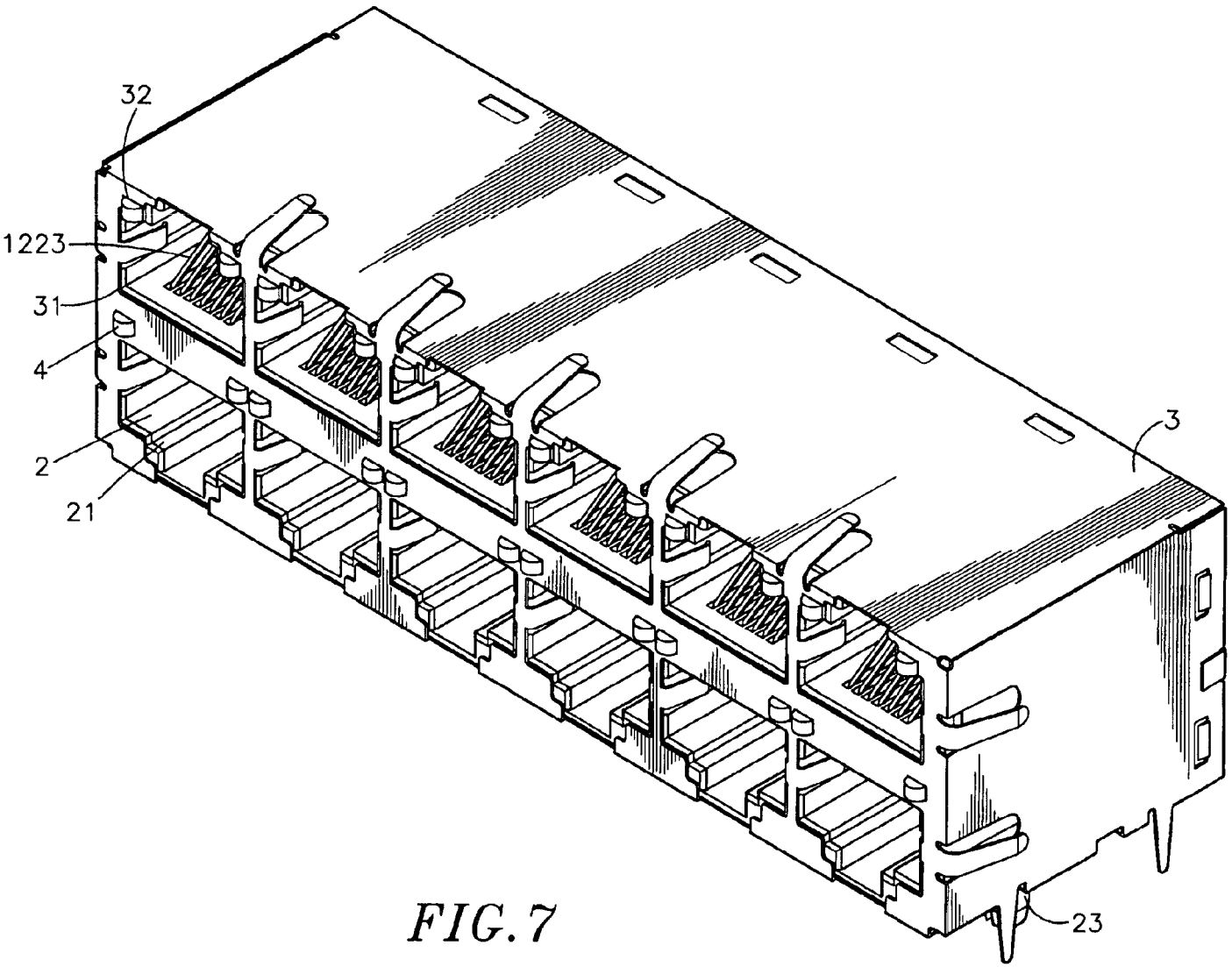
FIG. 7 is an elevational view of a stacked multi port connector with light-emitting device according to another preferred embodiment of the present invention.

Furthermore, referring to FIGS. 6 and 7, elevational views of a stacked multi port connector with light-emitting element according to two different preferred embodiments of the present invention are shown. After positioning the adapting device 12 onto the surface of the back cover 11, a user can arrange the plurality of transmission module 1 according to the need and then cover with the frontal cover 2. The above light-emitting element 4 can also be arranged according to the users' requirement.

The frontal cover 2 can be formed as a single unit or can be a assembly of a plurality of elements. The back cover 11 can be optional, the description above is merely to describe the structure of a preferred embodiment of the present invention, not for limiting the scope of the present invention.

Additionally, the light-emitting element 4 can be comprised of a single color or a plurality of colors. The single color can be for example, red or green. The light-emitting element 4 can indicate whether the network connection is being activated, unable to link up or indicate the transmission speed by showing no light emission or flashing of light. If the light-emitting element 4 is comprised of a plurality of colors, it can be for example, red, green or other colors to indicate the status as mentioned as above.

The stacked multi port connector with the light-emitting element of the present invention at least has the following advantages.

1. The transmission terminal 124 of the adapting device 12 is positioned between the protrusion 23 of the frontal cover 2 and the signal input terminal 113 of the back cover 11, and the light-emitting element 4 can be fitted through the plurality of slots 21 of the frontal cover 2 without occupying any additional space on the stacked multi port connector and therefore the inclusion of the light-emitting element 4 does not increase the size of the stacked multi port connector.

2. After positioning the adapting device 12 onto the surface of the back cover 11, the frontal cover 2 can be used to cover adapting device 12 in an orderly manner to function as a stacked multi port connector. Further, the plurality of slots 21 of the frontal cover 2 can be designed to fit the light-emitting elements 4 according to the need of the user.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A stacked multi port connector with the light-emitting element, comprising:

a transmission module, having an adapting device, a positioning set, a frontal cover and a plurality of light-emitting elements, wherein said adapting device comprises a terminal set having a plurality of signal output terminals penetrating there-through;

said positioning set is positioned at a bottom face of said adapting device, and said positioning set comprises a plurality of transmission terminals and a plurality of signal input terminals penetrating there-through;

said frontal cover comprises a plurality of slots formed on a surface thereon and a plurality of receiving spaces for positioning said light-emitting elements, and a plurality of protrusions are formed on two sides of a bottom flange, and wherein said frontal cover covers an outer portion of said adapting device, and said signal output terminals of adapting advice is positioned between said protrusions of the frontal cover and signal input terminals of said back cover; and a case, covering said transmission module;

wherein said terminal set comprises an protruded upper portion and a lower portion for fitting a plurality of signal output terminals, a through channel for fitting said light-emitting element is formed between said upper portion and lower portion, and a connecting circuit board for connecting and positioning said light-emitting elements is formed at a backside of said terminal set, and said transmission terminal has bent portion for connecting to said connecting circuit board.

2. The stacked multi port connector with the light-emitting element according to claim 1, wherein said connecting circuit board of said adapting device comprises a through groove, and a signal connecting circuit board is positioned at a rear side of said connecting circuit board, and wherein said signal output terminal comprises a base having a welding portion on one side and a receiving end portion on another side thereof, said welding portion penetrating through said through groove of connecting circuit board and welded securely onto said signal connecting circuit board.

3. The stacked multi port connector with the light-emitting element according to claim 1, wherein a receiving space for positioning an electrical device is formed between said positioning set and adapting device, and wherein said back cover covers an outer portion of said receiving space.

4. The stacked multi port connector with the light-emitting element according to claim 3, wherein said back cover has a plurality of buckles at a bottom flange and corresponding buckling grooves at two sides of said positioning set for buckling said buckles of said back cover.

5. The stacked multi port connector with the light-emitting element according to claim 1, wherein said case has a plurality of receiving holes and fitting holes formed on a surface thereon.

6. The stacked multi port connector with the light-emitting element according to claim 1, wherein said light-emitting element comprises a single color.

7. The stacked multi port connector with the light-emitting element according to claim 1, wherein said light-emitting element comprises a plurality of colors.

8. The stacked multi port connector with the light-emitting element according to claim 1, wherein the plurality of said transmission terminals and said signal input terminals are fitted into said through holes of the positioning set.

* * * * *